US005775014A

United States Patent [19]

Lin

[11] Patent Number: 5,775,014

[45] Date of Patent: Jul. 7, 1998

[54] CRYSTAL WATER GLOBE

[76] Inventor: Chung-kuei Lin, 6F-4, No.1, Wuchuan 1st Rd., Wuku Industrial Dist., Hsinchuang City, Taipei Hsien, Taiwan

[21] Appl. No.: 707,294

[22] Filed: Sep. 3, 1996

[51] Int. Cl.[6] ..... G09F 19/00

[52] U.S. Cl. ..... 40/406; 40/409; 40/411

[58] Field of Search ..... 40/406, 409, 410, 40/411; 446/236, 267

[56] References Cited

U.S. PATENT DOCUMENTS

| | | | |
|---|---|---|---|
| 4,852,283 | 8/1989 | Teng | 40/410 X |
| 5,018,288 | 5/1991 | Yang | 40/406 |
| 5,131,175 | 7/1992 | Liu | 40/410 |
| 5,286,535 | 2/1994 | Hou | 446/267 X |
| 5,313,727 | 5/1994 | Murray, Jr. | 40/410 |
| 5,396,723 | 3/1995 | Liu | 40/406 |
| 5,548,912 | 8/1996 | Liu | 40/410 X |

*Primary Examiner*—Brian K. Green

*Attorney, Agent, or Firm*—Kerkam, Stowell, Kondracki & Clarke; Dennis P. Clarke

[57] ABSTRACT

A crystal water globe comprising a housing assembly having a lower housing and a transmission having a motor-driven shaft extending through the lower housing. Movable decorations or figures of the crystal water globe and a motor are disposed at opposite sides of the lower housing. Plugs sealingly connected to the lower housing and heavy oil contained between the plugs and the lower housing are utilized to seal the interface between the motor-driven shaft and the plugs.

9 Claims, 6 Drawing Sheets

CRYSTAL WATER GLOBE

BACKGROUND OF THE INVENTION

1. Field of the Invention

The present invention relates to decorative articles and more particularly to a crystal water globe which exhibits multi-functional entertainment.

2. Description of Related Art

Prior crystal water globe or similar articles are too simple in structure such that they can be termed as 'static,' which means they lack other auxiliary or added functions except for very simple ones like exhibition of decorations and making sound. It is thus desirable to have a crystal water globe which is versatile or 'dynamic' as to provide a combination of rotational parts, splashing water flow and lighting, in addition to static exhibitions.

However, it is encountered that water within the globe may leak out wherever possible. The problem of leakage is more serious when a motor-driven rotating part is involved.

SUMMARY OF THE INVENTION

A primary object of the present invention is to provide a crystal water globe which comprises means sealingly confining water within a closed enclosure so that there is no water leakage.

In accordance with a feature of the invention, the crystal water globe comprises a housing assembly which comprises means for sealingly interposed between an outer periphery of the housing assembly and an inner bottom rim of a globe.

In accordance with another feature of the present invention, the crystal water globe comprises a transmission which comprises means for producing a circulating water flow and the housing assembly comprises means for guiding the water flow to produce a turbulent flow.

In accordance with still another feature of the present invention, the crystal water globe further comprises a transparent tube extending through the housing assembly and a bulb situated within the transparent tube to provide lighting effect.

Other objects and novel features of the invention will become more apparent from the following detailed description when taken in conjunction with the accompanying drawings.

DETAILED DESCRIPTION OF PREFERRED EMBODIMENT

Figure 1:
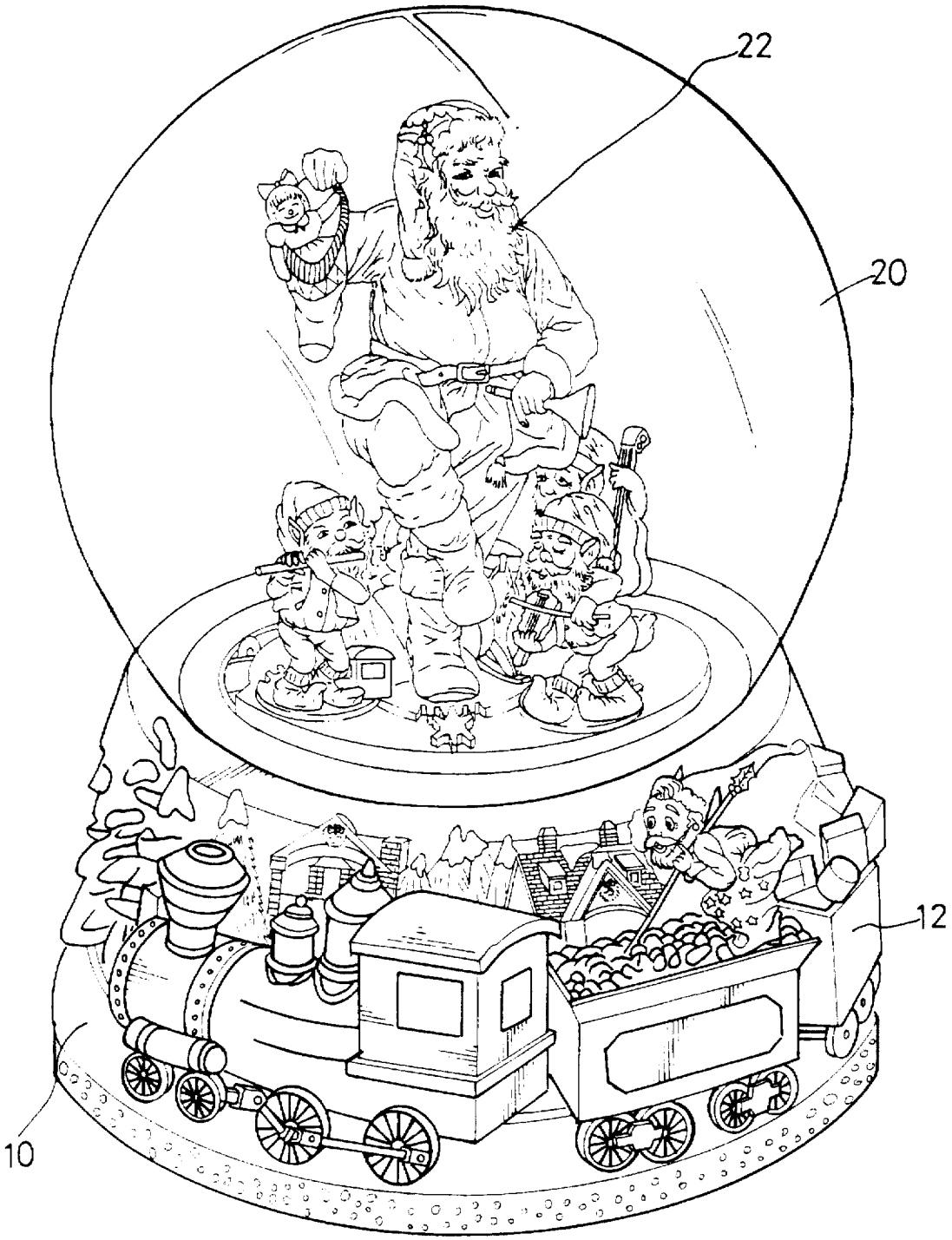
FIG. 1 is a perspective view of a crystal water globe in accordance with the present invention.

FIG. 1 shows a crystal water globe of the invention which comprises a base 10 and a globe 20 supported thereon. The base 10 has on its outer surface a lot of static decorations such as are identified by reference numeral 12 and movable decorations or figures such as are identified by reference numeral 22.

Figure 2:
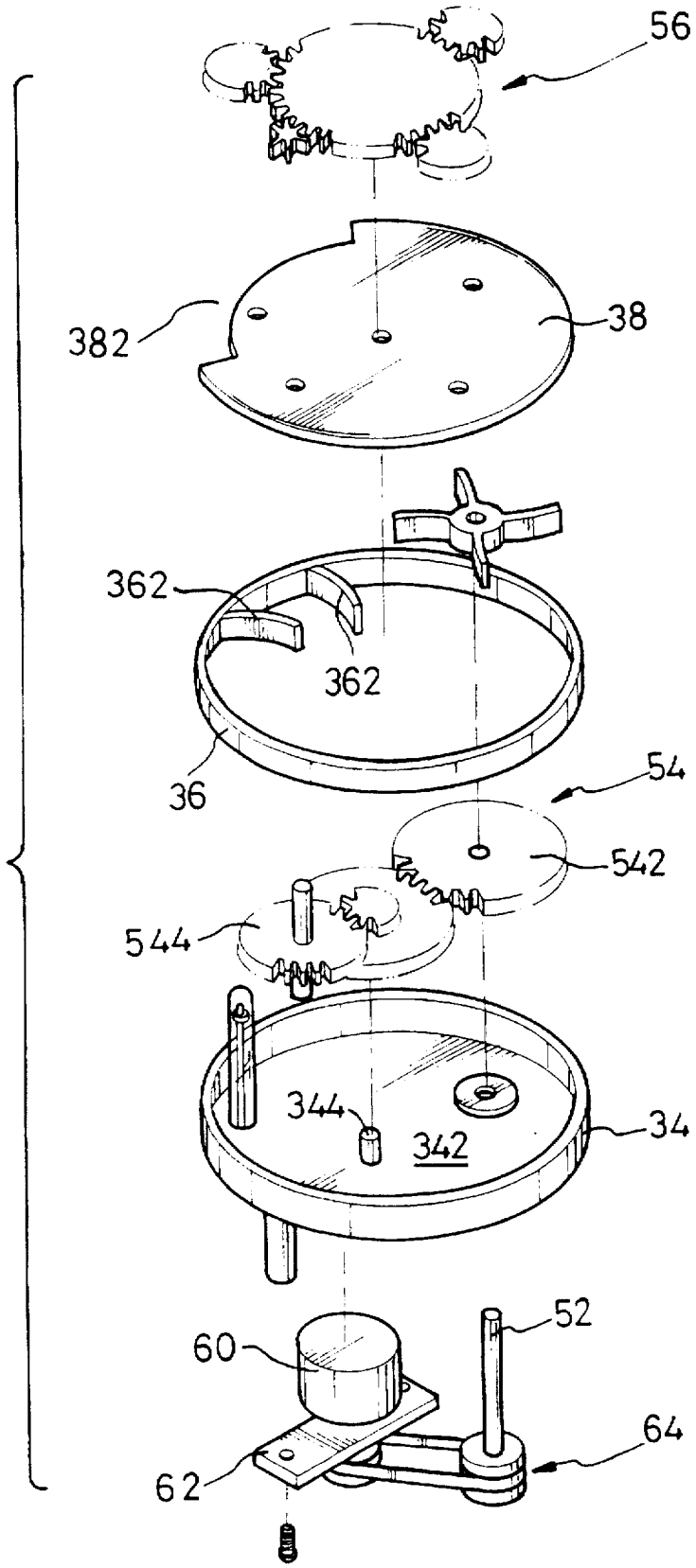
FIG. 2 is an exploded perspective view of the crystal water globe of FIG. 1, with certain parts removed for clarity.
Figure 3:
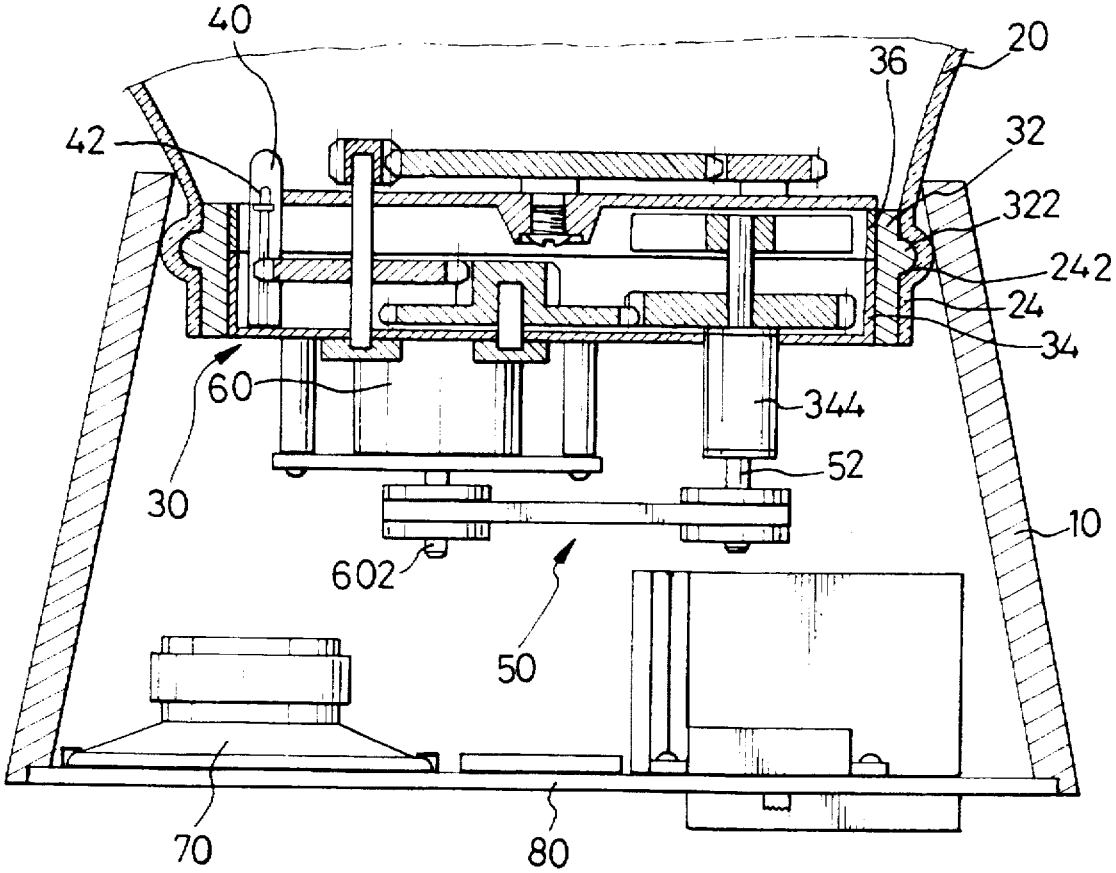
FIG. 3 is a partly cross-sectional view showing a bottom of the crystal water globe of the invention.
Figure 5:
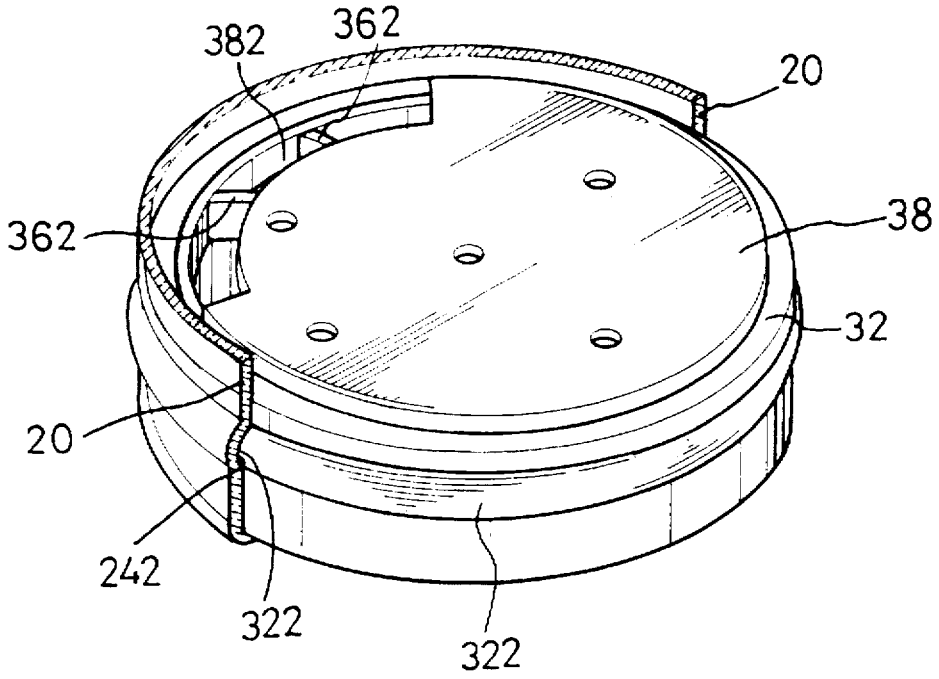
FIG. 5 is a schematic view showing the connection between a globe and a housing assembly in accordance with the invention.

Referring now to FIGS. 2 and 3, a housing assembly 30 is shown affixed to an inner bottom rim 24 of the globe 20. The housing assembly 30 comprises a rubber ring 32 having an annular ridge 322 formed at an outer periphery thereof. The globe 20 has an annular depression 242 at an inner periphery thereof for engaging with the ridge 322 (see also FIG. 5). The rubber ring 32 is thus sealingly interposed between the housing assembly 30 and the globe 20.

The housing assembly 30 has a lower housing 34 with a floor 342 and a tubular portion 344 extending from the floor 342. An upper ring 36 is situated on the lower housing 34. The upper ring 36 has a plurality of curved ribs 362 formed at an inner wall thereof. A cover 38 is provided on a top of the upper ring 36 and has a notch 382 at a position right above the curved ribs 362. A transparent tube 40 extends through the lower housing 34 and a bulb 42 is situated within the transparent tube 40. The tube 40 can be either integrally formed on the lower housing 34 or be formed as a separate piece sealingly received to a hole in the lower housing 34.

To turn the movable decorations or FIGS. 22 under a circumstance where the housing assembly 30 is filled with water, a transmission 50 is provided which is supported on and extends through the lower housing 34 and means is also provided for sealingly confining water within a closed enclosure defined between the globe 20 and the housing assembly 30 so that the water will not leak due to the provision of such a transmission 50. The transmission 50 comprises a motor-driven shaft 52 which extends through the lower housing 34, a gear train 54 rotatably supported by the lower housing 34 and operably driven by the motor-driven shaft 52, and a plurality of output gears 56 rotatably supported by the cover 38 and operably driven by the gear train 54. It is the output gears 56 that carry the movable FIGS. 22.

Figure 4:
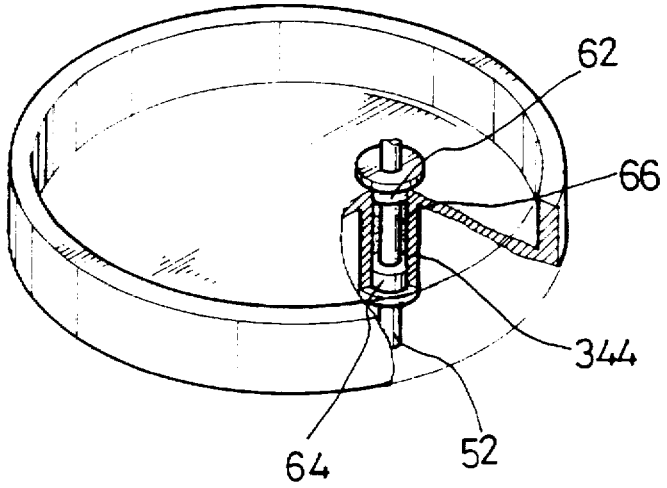
FIG. 4 shows a means for sealingly confining water in accordance with the present invention.

Referring to FIG. 4, for preventing water from possibly leaking as a result of the shaft 52 extending through the lower housing 34, a first plug 62 and a second plug 64 each made of rubber are respectively provided on an upper end and a lower end of the tubular portion 344 forming a part of and extending from the lower housing 34, and a quantity of heavy oil 66, such as lubricating oil is filled within a space enclosed by an inner wall of the tubular portion 344 and the first and the second plugs 62 and 64. The shaft 52 of the transmission 50 then extends through the first and the second plugs 62 and 64. This arrangement, i.e., the first and second plugs 62 and 64 and the oil 66 can effectively prevent the water above the first plug 62 from leaking down along the shaft 52 through the interface between the shaft 52 and the first plug 62.

Figure 7:
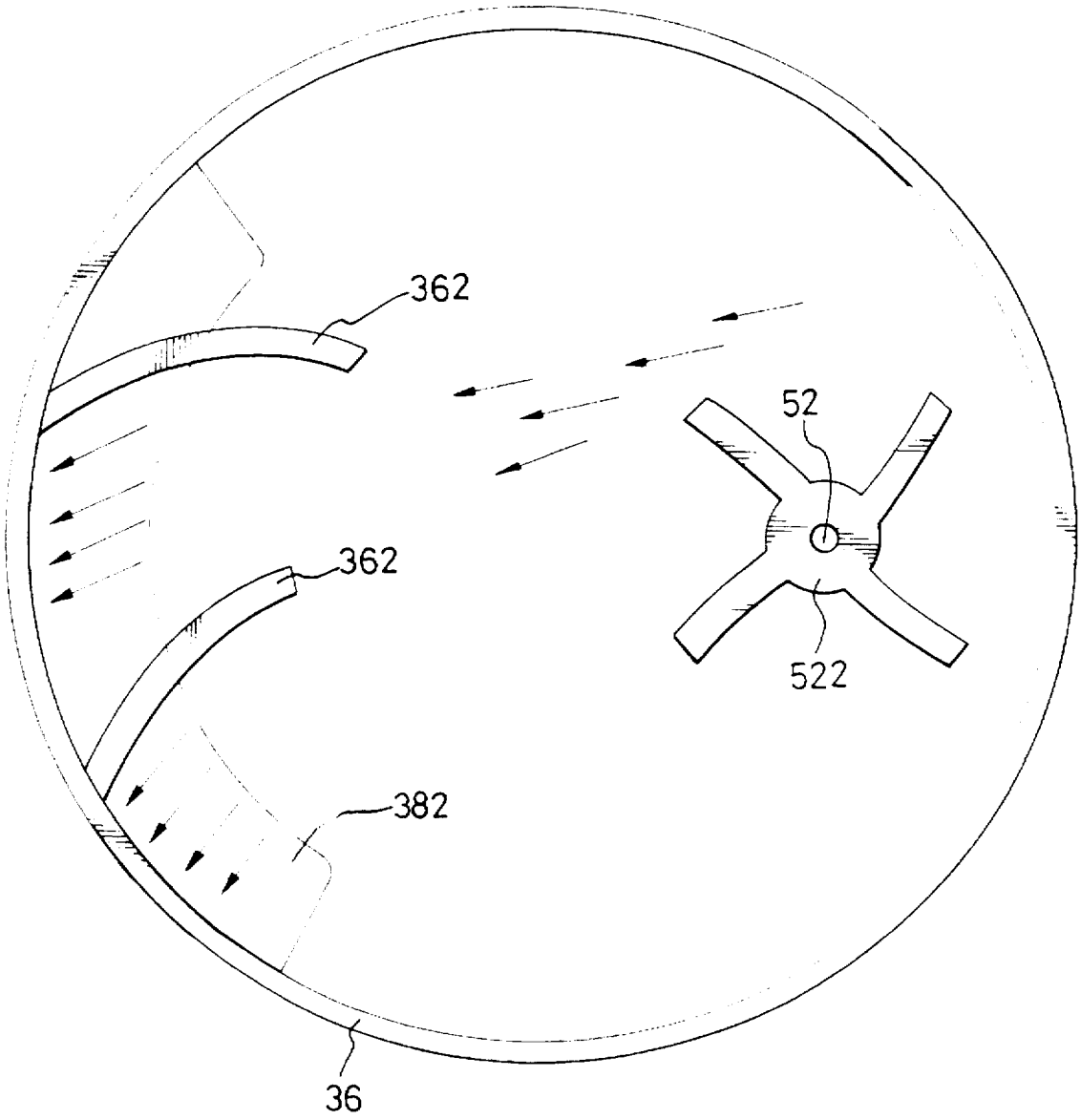
FIG. 7 shows the construction of a paddle and a pair of curved ribs,used for producing a desired water flow.

To produce a desired turbulent flow, the transmission 50 comprises a paddle 522 fixed on the motor-driven shaft 52 for urging water toward the curved ribs 362 and the curved ribs 362 guide the water flow to impact on the inner wall of the ring 36 and then move upward, as shown by arrows in FIG. 7.

Figure 6:
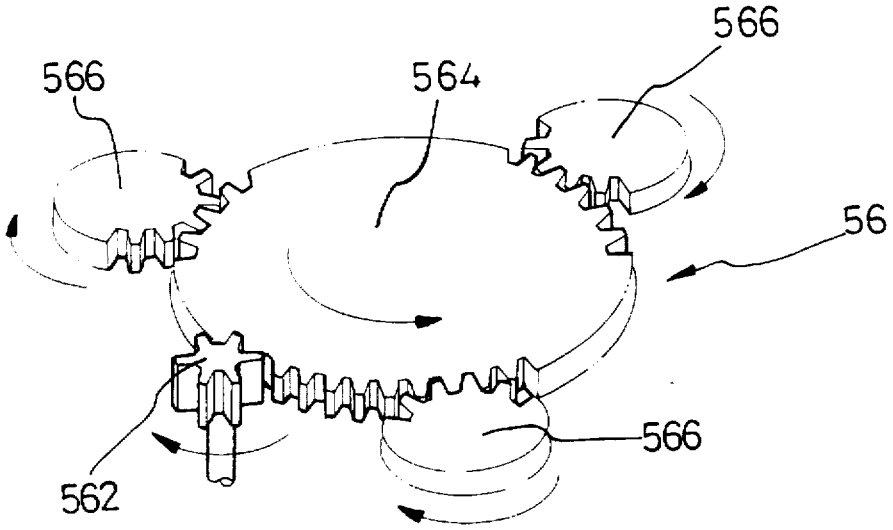
FIG. 6 particularly shows a gear train constituting a part of a transmission according to the invention.

FIG. 6 shows the plurality of output gears 56 in particular. The plurality of output gears 56 consists of a driving gear 562, a central gear 564 and three peripheral gears 566 equi-spaced around and in mesh with the central gear 564. FIG. 2 shows that the gear train 54 consists of a driving gear 542 fixed on the shaft 52 and an end gear 544 fixed on a common shaft with the driving gear 562 of the output gears 56. The driving gear 542 thus drives the end gear 544 via a number of idle gears (not numbered) which turns together with the driving gear 562 due to the common shaft connecting the gears 544 and 562.

In this invention, the motor for driving the shaft 52 is disposed outside the lower housing 34 within the base 10. Preferably, the motor 60 is supported on a bracket 62 fixedly mounted to the lower housing 34. A belt-and-pulley combination 64 is coupled between an output shaft 602 (see FIG. 3) of the motor 60 and an end 522 of the motor-driven shaft 52.

It is noted that in this invention the only possible water leakage is in connection with the motor-driven shaft 52. Those gears, such as the idle gears and the end gear 544 of the gear train 54 and the gears 562, 564, 566 of the output gears 56, can be suitably supported on the lower housing 34 and the cover 38, respectively, by forming pins, such as pin 344 on the floor 342 of the lower housing shown in FIG. 2, and mounting associated gears on these pins.

It is contemplated that glitters can be immersed in the water so that when the water is flowing and the bulb 42 is lit, the glitters will look like twinkling stars. Unlike conventional manually operated device, the glittering phenomenon in this invention occurs automatically and continuously.

Also, auxiliaries such as a speaker 70 can be suitably disposed within the hollow space of the base 10 and preferably on a bottom board 80, as shown in FIG. 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A crystal water globe comprising:

a base;

a globe supported by the base;

a housing assembly affixed to an inner bottom rim of the globe, the housing assembly having a tubular extension and a first plug and a second plug, respectively, attached to one of two ends of the tubular extension;

a transmission supported on the housing assembly and having a motor-driven shaft extending through the first and the second plugs; and a quantity of heavy oil filled within a space enclosed by an inner wall of the tubular extension and the first and the second plugs; the tubular extension, the first and second plugs and the oil sealingly confining water within a closed enclosure defined between the globe and the housing assembly.

2. The crystal water globe as claimed in claim 1, wherein:

the housing assembly comprises a rubber ring with an annular ridge formed at an outer periphery thereof; and the globe has an annular depression at an inner periphery thereof for engaging with the ridge.

3. The crystal water globe as claimed in claim 1, wherein the transmission comprises means for producing a circulating water flow and the housing assembly comprises means for guiding the water flow to produce a turbulent flow.

4. The crystal water globe as claimed in claim 1, wherein:

the housing assembly comprises:

a lower housing having a floor and a tubular portion extending from the floor, and a cover supported above the lower housing; and the transmission comprises:

a motor-driven shaft extending through the lower housing, a gear train rotatably supported by the lower housing and operably driven by the motor-driven shaft, and a plurality of output gears rotatably supported by the cover and operably driven by the gear train.

5. The crystal water globe as claimed in claim 4, wherein:

the housing assembly comprises an upper ring situated on the lower housing, the upper ring having a plurality of curved ribs at an inner wall thereof, the cover resting on a top of the upper ring and exposing the curved ribs; and the transmission comprises a paddle rotatably fixed on the motor-driven shaft for producing a circulating water flow, the curved ribs converting the rotating water flow to a turbulent flow.

6. The crystal water globe as claimed in claim 4, wherein the transmission comprises a motor supported below the lower housing and a belt-and-pulley combination coupled between an output shaft of the motor and an end of the motor-driven shaft.

7. The crystal water globe as claimed in claim 4, wherein the gear train comprises an end gear and one of the plurality of output gears comprises a peripheral gear coaxial with the end gear.

8. The crystal water globe as claimed in claim 4, wherein the plurality of output gears comprise a driving gear, a central gear and three peripheral gears in mesh with the central gear.

9. The crystal water globe as claimed in claim 1, further comprising a transparent tube extending through the housing assembly and a bulb situated within the transparent tube.

* * * * *